US010553955B2

(12) United States Patent
Tankielun et al.

(10) Patent No.: US 10,553,955 B2
(45) Date of Patent: Feb. 4, 2020

(54) ANTENNA ELEMENT AND ANTENNA SYSTEM

(71) Applicant: Rohde & Schwarz GmbH & Co. KG, Munich (DE)

(72) Inventors: Adam Tankielun, Ottobrunn (DE); Arslan Azhar, Munich (DE)

(73) Assignee: ROHDE & SCHWARZ GMBH & CO. KG, Munich (DE)

( * ) Notice: Subject to any disclaimer, the term of this patent is extended or adjusted under 35 U.S.C. 154(b) by 200 days.

(21) Appl. No.: 15/298,912

(22) Filed: Oct. 20, 2016

(65) Prior Publication Data

US 2018/0115078 A1 Apr. 26, 2018

(51) Int. Cl.
*H01Q 17/00* (2006.01)
*H01Q 13/08* (2006.01)

(52) U.S. Cl.
CPC ..... *H01Q 17/001* (2013.01); *H01Q 13/085* (2013.01)

(58) Field of Classification Search
CPC ..... H01Q 13/106; H01Q 9/0485–0492; H01Q 13/085; H04B 17/102
See application file for complete search history.

(56) References Cited

U.S. PATENT DOCUMENTS 8,089,417 B2 * 1/2012 Popovic ..... A61B 5/05 343/700 MS

* cited by examiner

*Primary Examiner* — Jessica Han
*Assistant Examiner* — Amal Patel
(74) *Attorney, Agent, or Firm* — Schwabe, Williamson & Wyatt, P.C.

(57) ABSTRACT

An antenna element for receiving and/or emitting electromagnetic waves is described. Said antenna element comprises a conductive portion made of a conductive material and a resistive portion made of a resistive material. Said conductive and resistive portions are directly adjacent to each other along at least 50% of at least one outer edge of the conductive portion wherein said antenna element is a tapered slotline antenna element. Further, an antenna system is described.

17 Claims, 1 Drawing Sheet

ANTENNA ELEMENT AND ANTENNA SYSTEM

TECHNICAL FIELD

The invention relates to an antenna element for receiving and/or emitting electromagnetic waves as well as an antenna system.

BACKGROUND OF THE INVENTION

In the state of the art, thin-film tapered slotline antennas are known which comprise at least one tapered slotline antenna element used for receiving and/or emitting electromagnetic waves. The tapered slotline antennas (TSAs) are typically used for determining and/or measuring radiation and signal characteristics of wireless devices over the air (OTA). The tapered slotline antennas are also called Vivaldi antennas.

In US 2009/0015832 A1, a typical tapered slotline antenna is shown. The tapered slotline antenna comprises a substantially planar substrate as well as a pair of antenna elements which are arranged in a mirror image on the substrate. Thus, both antenna elements are located in the same plane defined by the substrate.

The antenna elements each comprise a conductive section and a resistive section adjoining the conductive section such that the tapered end of the tapered slotline antenna element is formed by the resistive section. However, the antenna elements known in the prior art as well as the antenna systems comprising such antenna elements have some disadvantages regarding the radio frequency performances.

Besides the tapered slotline antennas, standard gain horn (SGH) antennas are also used for measuring and analyzing communication devices such as a 4G and/or 5G wireless device.

However, the standard gain horn antennas are large and they have a relative small frequency range for testing and analyzing purposes.

SUMMARY OF THE INVENTION

The invention provides an antenna element of an antenna system for receiving and/or emitting electromagnetic waves, said antenna element comprising a conductive portion made of a conductive material and a resistive portion made of a resistive material, said conductive and resistive portions being directly adjacent to each other along at least 50% of at least one outer edge of the conductive portion wherein said antenna element is a tapered slotline antenna element.

The invention is based on the finding that the characteristics of the antenna element can be improved by using additional resistive material which is located directly adjacent to the outer edge of the conductive portion resulting in lower side lobes and a lower back lobe in the radiation pattern of the antenna element. Accordingly, the main radiation beam is not split which results in better electromagnetic performance characteristics of the antenna element or the antenna system. Particularly, the electromagnetic waves are guided better towards a device under test to be tested by the antenna system.

According to an aspect, said outer edge is substantially parallel to the main direction of said antenna element. The main direction approximately corresponds to the propagation direction of the electromagnetic waves generated by the antenna system. Accordingly, the antenna element extends along this axis towards the aperture of the antenna element.

Hence, the additional resistive portion also extends along the axial main direction towards the aperture of the antenna element.

According to another aspect, said antenna element comprises a tapered section at one end. Since the antenna element is a tapered slotline antenna element, one end of the antenna element is typically tapered which corresponds to the tapered section. This tapered section defines inter alia the aperture of an antenna system comprising at least two antenna elements.

Further, said tapered section may comprise a resistive part made of a resistive material. This resistive material is used for ensuring the electromagnetic radiation characteristics of the antenna element. The tapered section, in particular the resistive part, is different to the additional resistive portion which extends along the outer edge of the conductive section. The resistive part adjoins the conductive portion at an edge being substantially perpendicular to the outer edge along which the additional resistive portion adjoins the conductive portion.

Said tapered section may further comprise an additional conductive part made of conductive material. Accordingly, the tapered section of the antenna element has a resistive part as well as an additional conductive part. In the state of the art, an antenna element only has a tapered section which is fully made of resistive material. The additional conductive material within the tapered section ensures that the voltage stand wave ratio (VSWR) is lowered. Moreover, the additional conductive material within the tapered section allows the usage of a higher resistive material which has better attenuation properties such that unwanted edge currents are at least minimized, in particular unwanted edge currents do not occur.

Further, said additional conductive part may have a width that decreases towards the tapered end of said antenna element. Accordingly, the additional conductive part becomes smaller along the orientation of the antenna element. This ensures the good electromagnetic characteristics of the antenna element.

Particularly, said width decreases towards the tapered end with a ratio width per length lower than 0.3. This slope of the width lowers the voltage stand wave ratio (VSWR) appropriately.

Generally, said conductive portion and said additional resistive portion may be part of a conductive section of said antenna element. The conductive section adjoins the tapered section. Thus, the antenna element comprises a conductive section having a conductive and an additional resistive portion as well as a tapered section having a resistive part and an additional conductive part. Hence, the conductive section and the tapered section each comprise resistive and conductive materials whereas the antenna element known in the state of the art only comprises a conductive section completely made of a conductive material and a tapered section completely made of a resistive material. In other words, the conductive section of the antenna element according to the invention comprises an additional resistive material whereas the tapered section comprises an additional conductive material.

According to another aspect, said tapered section has two outer tapering edges wherein said tapering edges are substantially formed by conductive material and resistive material. The outer tapering edges limit a middle portion of the tapered section which extends till the tapered end. The middle portion of the tapered section can be made of a high resistive material for better attenuation of unwanted edge currents. Accordingly, the area having a change in resistance between this outer tapering edge and the middle portion of the tapered section is increased due to the neighboring conductive material.

Particularly, said tapering edges are established in the transition area by said additional resistive portion and said additional conductive part. Thus, the antenna element comprises four different portions/parts.

Said resistive material may have a sheet resistance value between 25 and 1,000 Ohm. This sheet resistance value is considerably increased with respect to the resistance values typically used by the resistive materials of the antenna elements known in the prior art. As already mentioned, the attenuation properties of the unwanted edge currents are improved.

The invention further provides an antenna system comprising at least two antenna elements as mentioned above. The advantages mentioned above also apply for the antenna system in a similar manner. The antenna system may be a usual antenna unit wherein both antenna elements are arranged in an axially symmetrical manner.

Furthermore, both antenna elements may be arranged in planes being orthogonal with respect to each other. Hence, a dual polarized measurement antenna system can be provided. This antenna system may comprise two antenna units which are arranged perpendicular to each other. Thus, two antenna elements are provided which are orthogonal to each other. Such a measurement antenna system cannot be provided by a standard gain horn (SGH) antenna known in the prior art.

BRIEF DESCRIPTION OF DRAWINGS

The invention will now be described with reference to exemplary embodiments which are shown in the enclosed drawings. In the drawings, FIG. 1 schematically shows an antenna element according to the invention, and FIG. 2 schematically shows an antenna system according to the invention.

DETAILED DESCRIPTION

Figure 1:
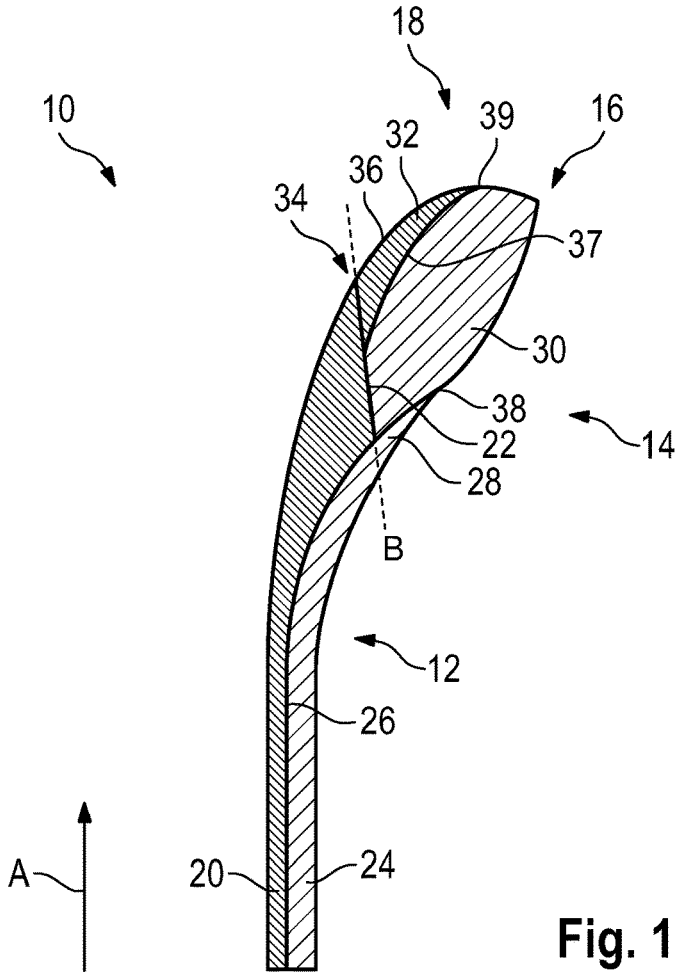

In FIG. 1, an antenna element 10 of a thin-film tapered slotline antenna unit is shown which can be used to measure communication devices over the air, for instance the performance of 4G and/or 5G wireless devices.

The antenna element 10 extends along a main direction A which substantially corresponds to the propagation direction of the electromagnetic waves generated by the antenna unit.

The slotline tapered antenna element 10 comprises a conductive section 12 and a tapered section 14 which adjoin each other. The dashed line B illustrates the limit between both sections 12, 14. The conductive section 12 is fed by a source whereas the tapered section 14 relates to a tapered end 16 of the tapered antenna element 10 corresponding to the aperture 18 of an antenna unit as will be described later.

The conductive section 12 comprises an elongated conductive portion 20 made of a conductive material which extends towards the tapered end 16 or the aperture 18. The conductive portion 20 ends at an inner edge 22 which limits the conductive section 12 and the tapered section 14 at least partly. Hence, the inner edge 22 substantially coincides with the dashed line B.

Further, the conductive section 12 comprises an additional resistive portion 24 made of a resistive material that is located directly adjacent to the conductive portion 20. The additional resistive portion 24 also extends towards the tapered end 16 or the aperture 18. As shown in FIG. 1, the additional resistive portion 24 is located at an outer edge 26 of the conductive portion 20 which is parallel to the main direction A of the antenna element 10. In the shown embodiment, the additional resistive portion 24 extends along the complete outer edge 26 of the conductive portion 20.

In addition, the conductive section 12 is slightly curved wherein the additional resistive portion 24 is located at the inner radius of the slightly curved conductive section 12.

Further, the additional resistive portion 24 has a resistive end 28 which merges into the tapered section 14 as will be described later.

The additional resistive portion 24 ensures that side lobes and back lobe are reduced in the radiation pattern of the antenna unit comprising two antenna elements 10. Accordingly, the main radiation beam is not split providing good radio frequency characteristics.

The tapered section 14 also has a resistive part 30 and an additional conductive part 32 which inter alia form the tapered section 14. Thus, the tapered section 14 comprises an additional conductive material with respect to the tapered section of antenna elements known in the prior art.

The additional conductive part 32 lowers the voltage stand wave ratio (VSWR) which enables the possibility to use high resistive material having better attenuation properties of unwanted edge currents. Hence, the radio frequency properties are improved.

Since the conductive section 12 and the tapered section 14 merge into each other, a transition area 34 is provided.

As shown in FIG. 1, the additional resistive portion 24 ranges from an end fed by a source along the conductive portion 20 of the conductive section 12 into the tapered section 14, in particular its resistive end 28. Thus, the additional resistive portion 24 is provided in the transition area 34 of both sections 12, 14.

Further, the conductive portion 20 also ranges from the end fed by a source along the main direction A of the antenna element 10 into the tapered section 14 forming the additional conductive part 32.

Therefore, the inner edge 22 separates the conductive section 12 and the tapered section 14 since the width of the conductive material dramatically changes at the inner edge 22 wherein the inner edge 22 is substantially parallel to the main direction A of the antenna element 10 due to the curved shape of the conductive section 12 in the transition area 34.

The width of the additional conductive part 32 gets smaller towards the tapered end 16 as can be seen in FIG. 1. Particularly, the width decreases towards the tapered end 16 or the aperture 18 with a ratio width per length being lower than 0.3.

Furthermore, the tapered section 14 comprises two outer tapering edges 36, 38 extending from the conductive section 12 towards the tapered end 16. The outer tapering edges 36, 38 are provided by the additional conductive part 30 and the additional resistive portion 24, respectively.

Generally, the additional resistive portion 24 and the resistive part 30 contact each other in the transition area 34, in particular the resistive end 28 of the additional resistive portion 24. Accordingly, they can be made of the same resistive material, in particular formed in one piece. The additional resistive portion 24 and/or the resistive part 30 may be formed by a material having a sheet resistance value between 25 and 1,000 Ohm.

In addition the conductive portion 20 and the additional conductive part 32 also contact each other. Thus, they can be made of the same conductive material, in particular formed in one piece. For instance, they are made by copper.

The conductive material and the resistive material are separated from each other by the outer edge 26 and the inner edge 22. Further, a third edge 37 is provided that extends from the inner edge 22 towards the tapered end 16 along the additional conductive part 32. Accordingly, the conductive material as well as the resistive material extends substantially from one end of the antenna element 10 to the opposite end.

As can be seen, the additional conductive part 32 extends till the tip portion 39 of the antenna element 10. The tip portion 39 is curved and located within the tapered section 14 such that a tangent at the tip portion 39 extends substantially normal to the main direction A of the antenna element. Hence, the tip portion 39 defines the axial end of the antenna element 10.

Figure 2:
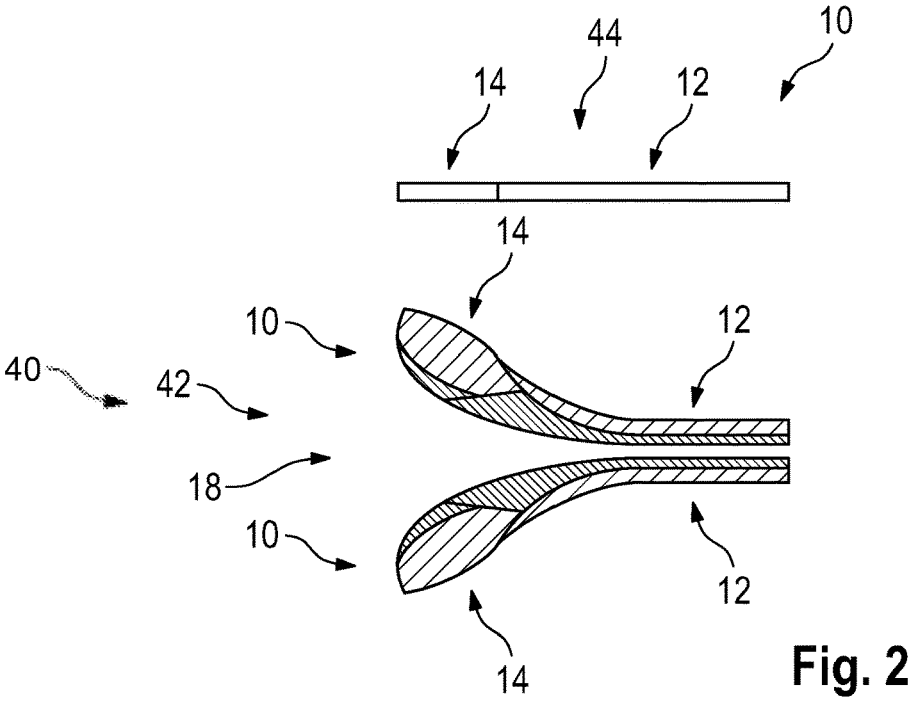

In FIG. 2, an antenna system 40 is shown which comprises two antenna units 42, 44 each formed by two antenna elements 10. The antenna elements 10 of each antenna unit 42, 44 are arranged in the same plane whereas the antenna units 42, 44 are arranged in planes being orthogonal to each other. Thus, the antenna system 40 comprises at least two antenna elements 10 being orthogonal to each other.

Accordingly, the antenna system 40 may be a dual polarized measurement antenna system.

The tapered sections 14 of both antenna elements 10 forming an antenna unit 42, 44 form the aperture 18 of the corresponding antenna unit 42, 44.

The conductive material of one antenna element 10 extends along the whole side facing the other antenna element 10 wherein these antenna elements 10 form the corresponding antenna unit 42, 44.

Generally, the electromagnetic waves emitted are better guided towards a device under test due to the design of the antenna element 10 due to the reduction of the side lobes and the back lobe. The voltage stand wave ratio of the antenna system 40 is decreased because of the additional conductive material in the tapered section 14, in particular the one of the antenna units 42, 44.

The antenna units 42, 44 are very compact wherein the components of the antenna units 42, 44 may be formed by a printed circuit board.

Since the electromagnetic performance of the antenna element 10 is improved, the sizes of the antenna unit 42, 44 and the antenna system 40 can be reduced. Further, their radar cross sections are lowered.

Moreover, the usable frequency range is increased. Thus, the antenna element 10 as well as the antenna system 40 can be used for more different purposes, in particular measurements.

Further, the environmental resistance of the antenna element 10 is improved, in particular humidity resistance. This also applies for the antenna system 40.

The invention claimed is:

1. An antenna element for receiving and/or emitting electromagnetic waves, said antenna element comprising:

a conductive portion made of a conductive material and an additional resistive portion made of a resistive material, said conductive and additional resistive portions being directly adjacent to each other along at least 50% of at least one outer edge of the conductive portion, wherein:

said antenna element is a tapered slotline antenna element, said conductive portion and said additional resistive portion being part of a conductive section of said antenna element, a tapered section adjoining said conductive section, said tapered section comprising a resistive part, said conductive section being slightly curved wherein said additional resistive portion is located at the inner radius of said slightly curved conductive section.

2. The antenna element according to claim 1, wherein said antenna element extends along a main direction, and wherein said outer edge is substantially parallel to the main direction of said antenna element.

3. The antenna element according to claim 1, wherein said antenna element comprises said tapered section at one end.

4. The antenna element according to claim 1, wherein said resistive part is made of a resistive material.

5. The antenna element according to claim 4, including tapering edges established in a transition area by said resistive part and a conductive part.

6. The antenna element according to claim 1, wherein said tapered section further comprises an additional conductive part made of a conductive material.

7. The antenna element according to claim 6, wherein said additional conductive part has a width that decreases towards the tapered end of said antenna element.

8. The antenna element according to claim 7, wherein said width decreases towards the tapered end with a ratio width per length lower than 0.3.

9. The antenna element according to claim 1, wherein said tapered section has two outer tapering edges wherein said tapering edges are substantially formed by a conductive material and a resistive material.

10. The antenna element according to claim 9, wherein said tapering edges are formed by said resistive part and a conductive part that extend from the conductive section into the tapered section.

11. The antenna element according to claim 1, wherein said resistive material has a sheet resistance value between 25 and 1,000 Ohm.

12. The antenna element according to claim 1, wherein the resistive portion ranges from an end fed by a source along the conductive portion of the conductive section into the tapered section, and wherein the conductive portion also ranges from the end fed by a source into the tapered section.

13. An antenna system comprising at least two antenna elements, each antenna element for receiving and/or emitting electromagnetic waves, wherein each antenna element comprises:

a conductive portion made of a conductive material and an additional resistive portion made of a resistive material, said conductive and additional resistive portions being directly adjacent to each other along at least 50% of at least one outer edge of the conductive portion wherein said antenna element is a tapered slotline antenna element, said conductive portion and said additional resistive portion being part of a conductive section of said antenna element, a tapered section adjoining said conductive section, said tapered section comprising a resistive part, said conductive section being slightly curved wherein said additional resistive portion is located at the inner radius of said slightly curved conductive section.

14. The antenna system according to claim 13, wherein both antenna elements are arranged in planes being orthogonal with respect to each other.

15. An antenna element for receiving and/or emitting electromagnetic waves, said antenna element comprising:

a conductive portion made of a conductive material and an additional resistive portion made of a resistive material, said conductive and additional resistive portions being directly adjacent to each other along at least 50% of at least one outer edge of the conductive portion wherein said antenna element is a tapered slotline antenna element, said conductive portion and said additional resistive portion being part of a conductive section of said antenna element, a tapered section adjoining said conductive section, said tapered section comprising a resistive part, wherein the additional resistive portion ranges from an end fed by a source along the conductive portion of the conductive section into the tapered section, and wherein the conductive portion also ranges from the end fed by a source into the tapered section.

16. The antenna element according to claim 15, wherein said antenna element extends along a main direction, the outer edge of the conductive portion being parallel to the main direction of the antenna element.

17. The antenna element according to claim 15, wherein said conductive section is slightly curved, said additional resistive portion being located at the inner radius of said slightly curved conductive section.

* * * * *